US006071159A

United States Patent [19]

Watanabe et al.

[11] Patent Number: 6,071,159

[45] Date of Patent: Jun. 6, 2000

[54] EXHAUST MANIFOLD FOR OUTBOARD MOTOR

[75] Inventors: Hitoshi Watanabe; Takahide Watanabe; Masanori Takahashi, all of Hamamatsu, Japan

[73] Assignee: Sanshin Kogyo Kabushiki Kaisha, Hamamatsu, Japan

[21] Appl. No.: 09/138,845

[22] Filed: Aug. 24, 1998

[30] Foreign Application Priority Data

Aug. 27, 1997 [JP] Japan ..... 9-244879

[51] Int. Cl.[7] ..... B63H 21/32

[52] U.S. Cl. ..... 440/89; 440/900; 123/195 P

[58] Field of Search ..... 123/195 P, 315, 123/84, 193.3, 195 HC; 440/900, 88, 89

[56] References Cited

U.S. PATENT DOCUMENTS 5,049,100 9/1991 Yamamoto et al. ..... 440/77

5,537,968 7/1996 Takahashi ..... 123/192.2

*Primary Examiner*—Ed Swinehart

*Attorney, Agent, or Firm*—Knobbe, Martens, Olson & Bear LLP

[57] ABSTRACT

An exhaust manifold for an outboard motor that has a vertically extending crankshaft and which exhaust manifold is formed in the cylinder head and cylinder block. The cylinder block forms the exhaust manifold by runner sections that are configured in such a way so as to facilitate the casting process by which they are formed and which provide an effective smooth flow path without requiring complex cores or patterns.

13 Claims, 3 Drawing Sheets

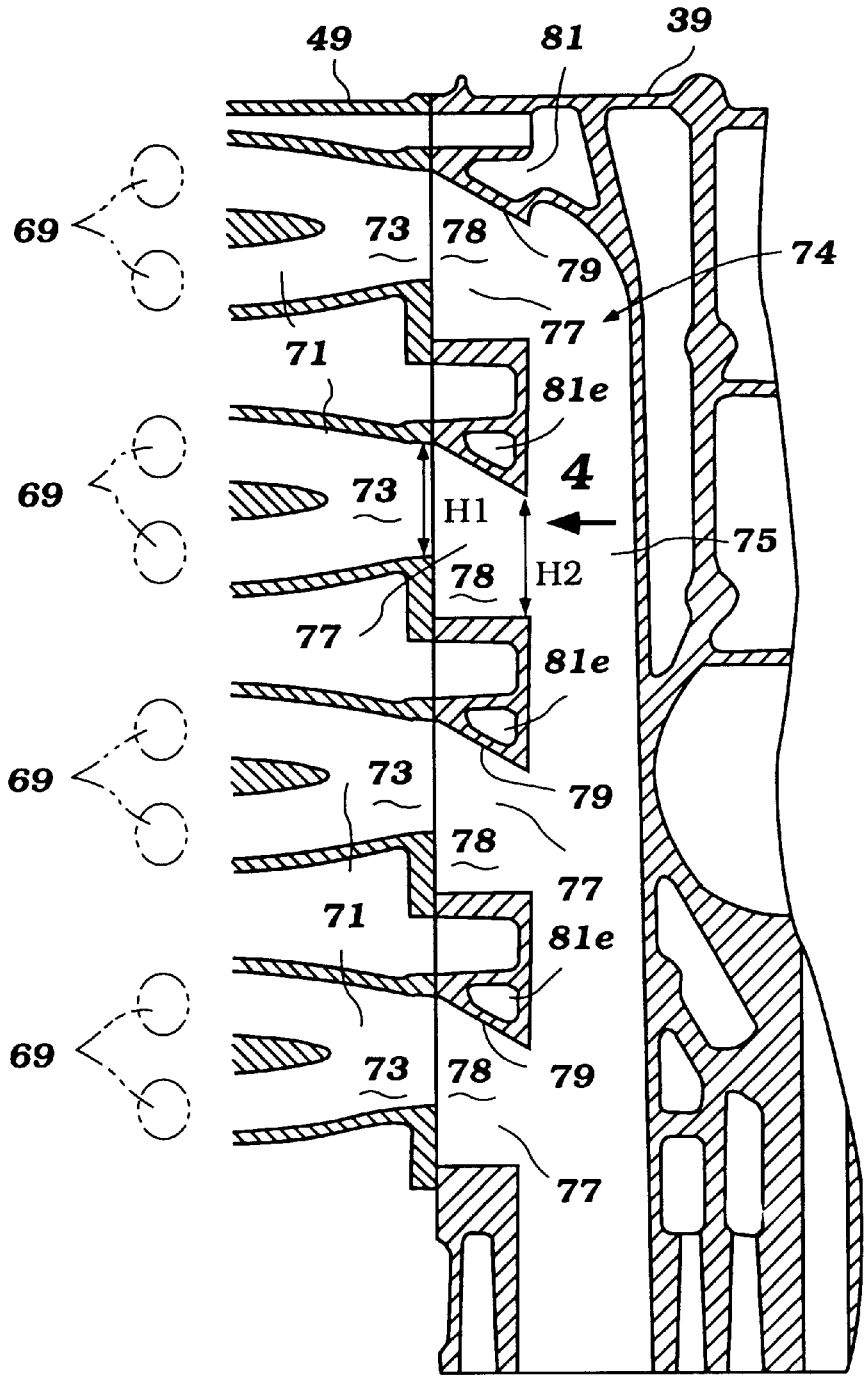
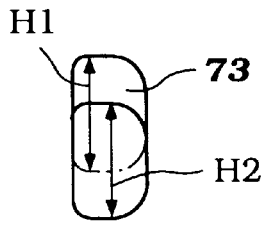
Figure 4
Figure 3

EXHAUST MANIFOLD FOR OUTBOARD MOTOR

BACKGROUND OF THE INVENTION

This invention relates to an exhaust system for a four cycle internal combustion engine and particularly for such an engine as utilized in the propulsion device for an outboard motor.

Although two cycle engines have been conventionally employed as the power plants in outboard motors due to their simplicity and high specific output, environmental and other concerns are creating increased interest in utilization of four cycle engines for these applications. In the interest of obtaining high specific outputs, the four cycle engines utilized for outboard motors should have overhead valves and preferably overhead camshafts and possibly even multiple valves per cylinder. Although this somewhat complicates the structure of the engine, it does assist in achieving higher efficiencies and better performance for a given size package.

Certain difficulties arise in connection with the application of four cycle engines for outboard motors. These arise in part, because of the fact that the engine in an outboard motor normally has its crankshaft rotating about a vertical rather than a horizontal axis. One of the components of the engine that is affected by this disposition is the exhaust system.

The design of exhaust systems for outboard motors is further complicated by the fact that the space available for silencing is quite limited. Thus, it is generally the practice to collect the exhaust gases from the engine and deliver them back to the atmosphere through an exhaust system that is formed in major part in the drive shaft housing and lower unit. This gives space for silencing devices such as expansion chambers and the like. In addition, the exhaust gases are discharged under normal running conditions through an underwater exhaust gas discharge.

Thus, if a four cycle engine and particularly an overhead valve four cycle engine is employed as a power plant in an outboard motor, there must be provided an exhaust system for the engine that will collect the exhaust gases and deliver them in a generally downward direction to the driveshaft housing and lower unit.

Although external exhaust manifolds can be employed for this purpose, the space limitations and the desire to obtain cooling for the exhaust system makes it desirable to discharge the exhaust gases actually through the engine body rather than through a separate exhaust manifold that is attached to the engine body.

There has been proposed, therefore, an arrangement where the cylinder head exhaust passages exit the combustion chambers and then curve in a re-entrant fashion so as to exit the cylinder head through openings formed in a surface of the cylinder head that extends parallel to the surface that engages the cylinder block to form the combustion chambers. With this type of arrangement, the cylinder block itself is formed with an exhaust collector section that is comprised of runner sections that mate with the cylinder head exhaust passage outlets and a collector section that extends generally vertically downwardly to communicate with an exhaust system provided in the driveshaft housing and lower unit.

In order to provide smooth flow of the exhaust gases and generally unrestricted flow, the cylinder block exhaust manifold is formed with curved runner sections that curve into the vertically extending collector section. Although the use of the curved runner sections provide a smooth flow, it offers significant problems in actually forming the cylinder block. It is desirable to avoid machining operations and the use of die casting techniques also is desirable. Such curved sections are, however, somewhat difficult to form in most die casting equipment.

It is, therefore, a principle object to this invention to provide an improved exhaust system for a four cycle engine as applied to an outboard motor.

It is a further object of this invention to provide an improved exhaust system for an overhead valve multi-cylinder engine wherein the exhaust manifold is formed in the cylinder block.

It is a further object of this invention to provide a cylinder block exhaust manifold for an engine that lends itself to outboard motor application and wherein the runner section can be conveniently and simply formed and will nevertheless offer a smooth and unrestricted exhaust gas path from the combustion chambers to the engine exhaust system.

SUMMARY OF THE INVENTION

This invention is adapt to be embodied in an internal combustion engine having a cylinder block that defines at least one horizontally extending cylinder bore. A cylinder head is affixed to the cylinder block and has a surface that closes the cylinder bore to form a combustion chamber with the cylinder bore and with a piston that reciprocates in the cylinder bore. At least one exhaust passage is formed in the cylinder head that extends from the cylinder head surface that closes the cylinder bore and which curves in a re-entrant fashion so as to form an exhaust gas opening in a surface of the cylinder head that extends parallel to the surface that closes the cylinder bore. The cylinder block has a portion that is in engagement with the cylinder head surface through which the exhaust passage opens. The cylinder block portion is formed with an exhaust manifold that includes a vertically downwardly extending passage and a runner section that extends from an opening that registers with the cylinder head exhaust gas opening and which terminates in the vertically extending portion. The cylinder block runners section has a first upper surface that is inclined downwardly toward the vertically extending section from its opening in the cylinder block and which is in line with the upper edge of the cylinder head exhaust passage opening. The lower opening portion of the cylinder block runner passage extends downwardly below the cylinder head exhaust passage opening and extends also to the vertically extending passage in the cylinder block so that the runners section has a tapered configuration that defines an inlet opening that has a greater vertical height than the cylinder head exhaust outlet opening.

BRIEF DESCRIPTION OF THE DRAWINGS

FIG. 3 is a cross-sectional view taken along the line 3—3 of FIG. 2 and shows the configuration of the exhaust passages leading from the combustion chambers to an exhaust gas system disposed in the driveshaft housing and lower unit of the outboard motor.

FIG. 4 is a view looking in the direction of the arrow 4 in FIG. 3 and shows the configuration at the inlet and outlet ends of one of the cylinder block exhaust runners and the relationship to the exhaust outlet opening of the cylinder head with which the runner cooperates.

DETAILED DESCRIPTION OF THE PREFERRED EMBODIMENT

Figure 1:
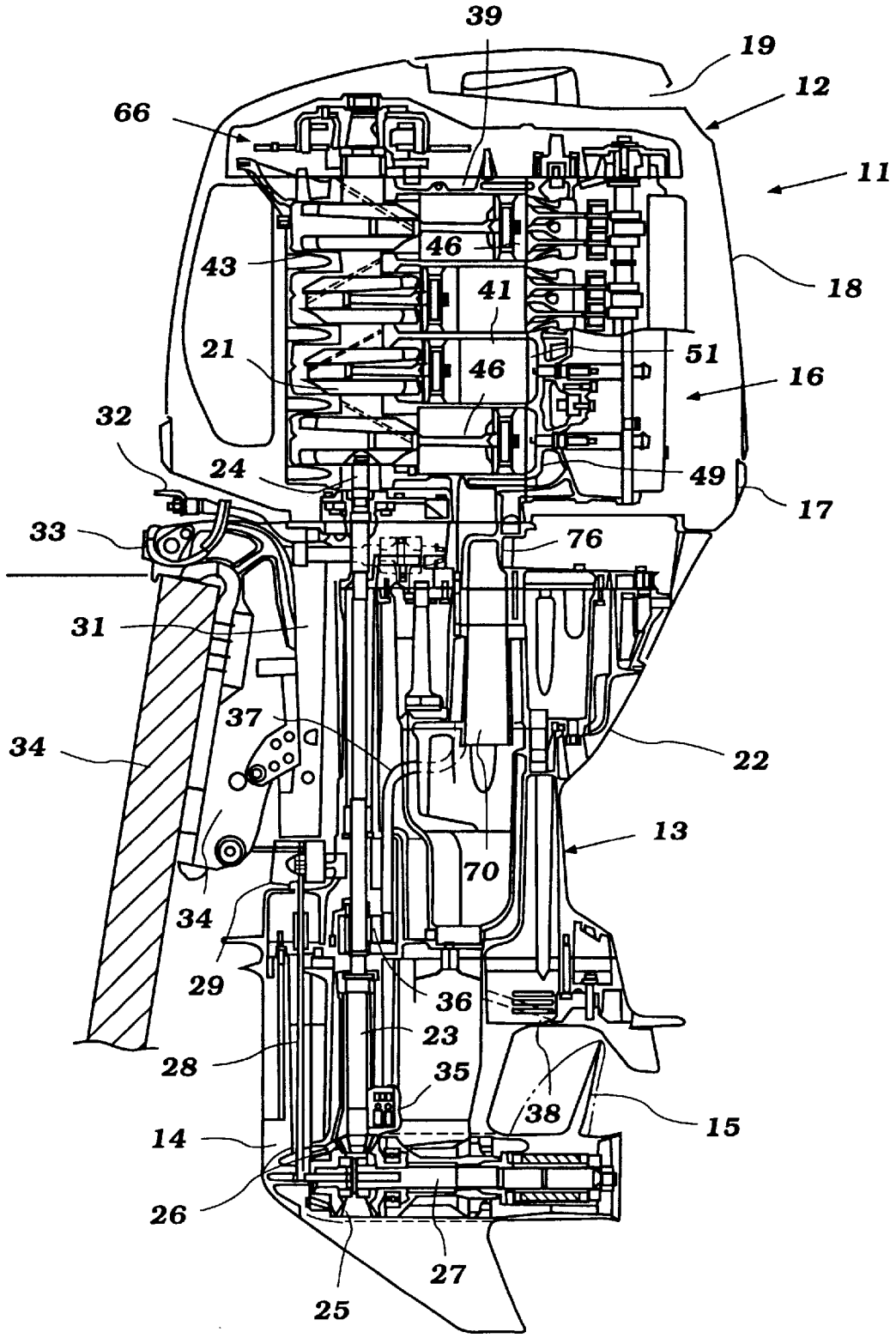
FIG. 1 is a side elevational view of an outboard motor that is shown attached to the transom of an associated watercraft that is shown partially and in cross-section. Portions of the outboard motor are broken away and shown in section.

Referring first to FIG. 1, an outboard motor constructed in accordance with an embodiment of the invention is identified generally by the reference numeral 11. The invention is described in conjunction with an outboard motor because the invention has particular utility in conjunction with arrangements where a four cycle internal combustion engine is disposed so that its crankshaft rotates about a vertically extending axis, as is the case with outboard motors. It will be readily apparent, however, from the following description how the invention can be practiced in conjunction with other applications for four cycle engines where they are mounted with such a crankshaft orientation.

The outboard motor 11 is comprised of a power head assembly, indicated generally by the reference numeral 12. A driveshaft housing and lower unit assembly 13 depends from the power head 12 and contains a lower unit 14 in which a water propulsion device, such as a propeller 15, is provided.

The power head 12 is comprised of an internal combustion engine, indicated generally by the reference numeral 16 and a surrounding protective cowling that is comprised of a lower tray portion 17 and an upper main cowling portion 18. The main cowling portion 18 is detachably connected to the tray 12 in a known manner. In addition, it is provided with an air inlet device 19 so as to admit atmospheric air to the interior of the protective cowling for entry into the induction system of the engine 16, in a manner which will be described. This air inlet opening 19 is preferably formed in such a way so as to permit relatively free air flow while precluding the entry of significant amounts of water to the interior of the main cowling portion 18.

Although the construction of the engine 16 will be described later in more detail by reference to the remaining figures, it will be seen that the engine 16 is mounted in the power head 12 so that its crankshaft 21 rotates about a vertically extending axis.

The driveshaft housing lower unit 13 includes a driveshaft housing portion 22 in which a driveshaft 23 is supported for rotation about a vertically extending axis. This facilitates a splined connection, indicated at 24, to the crankshaft 21 for establishing a driving relationship therebetween.

A conventional forward, neutral reverse, bevel gear transmission 25 is contained within the lower unit 14 and includes a driving bevel gear 26 that is affixed to the lower end of the drive shaft 23. This type of bevel gear transmission is well known in the art, and, therefore, a further description of it is not believed to be necessary to permit those skilled in the art to practice the invention.

This bevel gear reversing transmission drives a propeller shaft 27 to which the propeller 15 is affixed. A shift rod 28 is provided for shifting the transmission 25 between the forward, neutral and reverse drive conditions.

A steering shaft, which does not appear in the drawings, is affixed to the driveshaft housing portion 22 by means that includes a lower bracket assembly 29. This steering shaft is journaled for steering movement about a vertically extending axis within a swivel bracket 31. A tiller 32 is affixed to the upper end of this steering shaft for steering of the outboard motor 11 about this axis in a manner which is well understood in this art.

The swivel bracket 31 is pivotally connected by means of a pivot pin 33 to a clamping bracket 34. This pivotal connection permits tilt and trim movement of the outboard motor 11 in a manner which is also well known in this art.

The clamping bracket 34, in turn, contains a clamping or attachment device by which the outboard motor 11 is detachably connected to a transom 34 of a watercraft hull which is shown only partially and in cross-section.

As will become apparent as the description proceeds, the engine 16 is water-cooled. Cooling the water for the cooling jackets of the engine 16 is drawn from the body of water in which the outboard motor 11 is operating through a water inlet 35 formed in the lower unit 14. This water is drawn by a water pump 36 that is driven off of a lower end of the driveshaft 23 where the driveshaft housing 22 connects to the lower unit housing 14. The water is then delivered upwardly through a conduit 36 to the engine cooling jacket. This water is then returned to the body of water in which the watercraft operates through a water drain 38 that is formed in the lower unit 14.

Figure 2:
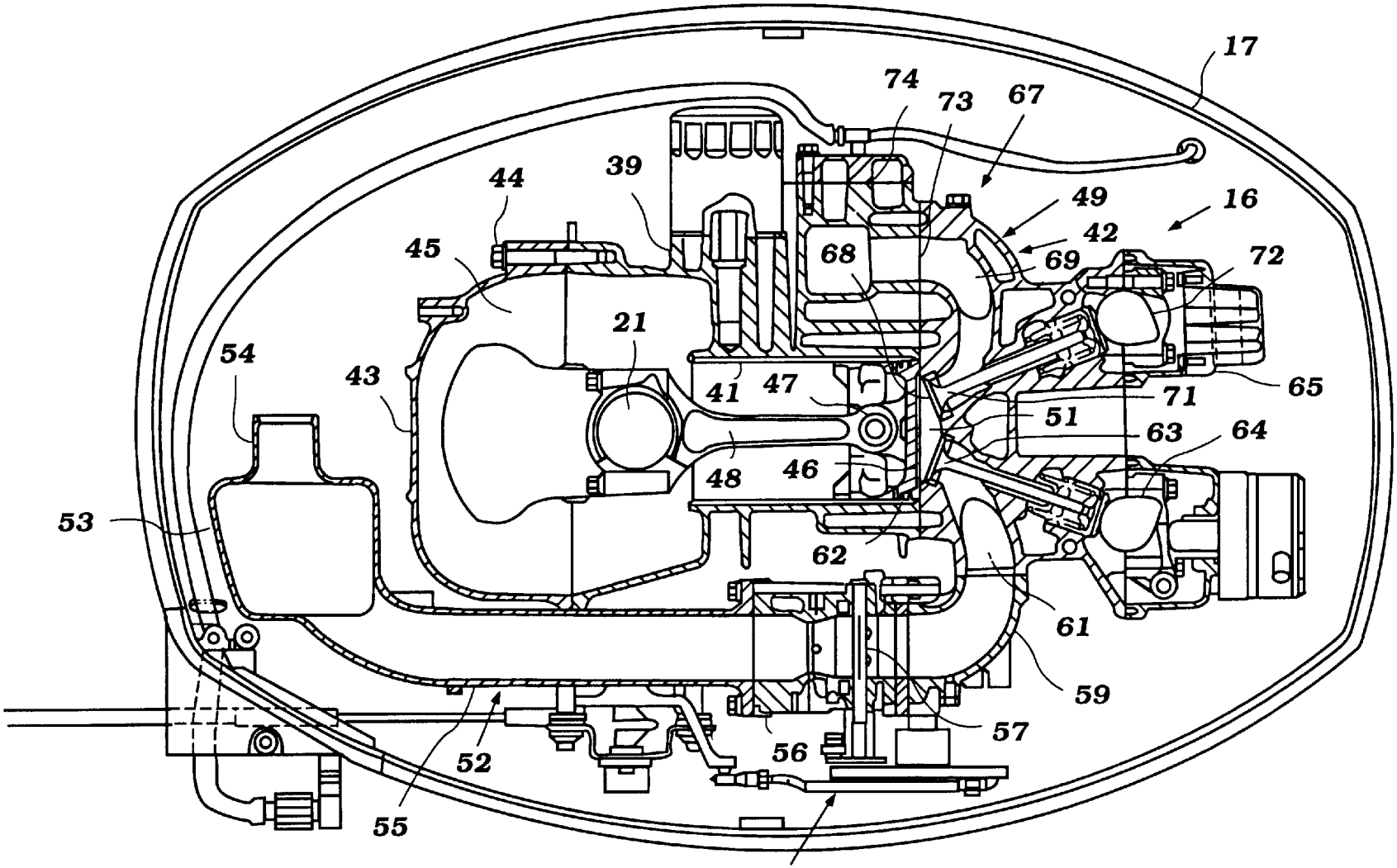
FIG. 2 is an enlarged top plan view of the power head of the outboard motor with the main protective cowling portion removed and with the engine shown in a cross-section taken along a plane that passes through the axis of one of the cylinder bores.

The construction of the outboard motor 11 as thus far described may be considered to be conventional. Since the invention deals primarily with the engine 16 and its exhaust system, further description of the general construction of the outboard motor 11 is not believed to be necessary to permit those skilled in the art to practice the invention. The construction of the engine 16 will now be described in detail by reference to the remaining figures with the initial discussion centering on FIGS. 1 and 2.

In the illustrated embodiment, the engine 16 is depicted as being of the four cylinder, in line type. Although such an engine configuration is illustrated and will be described, it will be readily apparent to those skilled in the art how the invention can be practiced with engines having a varying number of cylinders and varying cylinder placement so long as those engines are mounted so that their crankshafts rotate about vertically extending axis.

To this end, the engine 16 is provided with a cylinder block 39 in which four horizontally extending, vertically spaced cylinder bores 41 are formed. One end of these cylinder bores 41 is closed by a cylinder head assembly 42 that is detachably affixed to the cylinder block 39 in a generally known manner.

The other end of the cylinder bores 41 are closed by a crankcase member 43 that is detachably affixed to a skirt of the cylinder block 39 by threaded fasteners 44. This defines a crankcase chamber 45 in which the crankshaft 21 rotates. Any suitable bearing arrangement may be employed for this journalling of the crankshaft 21. This may include bearing caps that are formed integrally with the crankcase member 43 and which communicate with journal surfaces formed on webs of the cylinder block 39.

Pistons 46 reciprocate in each of the cylinder bores 41. These pistons 46 are connected by means of piston pins 47 to the upper or small ends of connecting rods 48. The lower or big ends of these connecting rods 48 are journaled in a known manner on the throws of the crankshaft 21.

The cylinder head assembly 42 includes a main cylinder head member 49 that is formed with individual recesses 51 which are in confronting relationship with the heads of the pistons 46 and which define with the pistons 46 and the cylinder bores 41 the combustion chambers of the engine. These cylinder head recesses 51 are formed in a surface of the cylinder head member 49 that sealingly engages the cylinder block 39, although a cylinder head gasket may be interposed therebetween.

An air charge is delivered to these combustion chambers by an induction system, indicated generally by the reference numeral 52 and which include an air inlet device 53 that is juxtaposed to the forward end of the crankcase member 43. An atmospheric air inlet opening 54 is formed in this inlet device 53 and draws air which has been admitted to the interior of the protective cowling through the aforenoted air inlet opening 19.

The inducted air is silenced and balanced in the inlet device 53 and then delivered through runner sections 55 to throttle bodies 56 in which throttle valves 57 are positioned. The throttle valves 57 are operated in unison by a linkage system 58 which is controlled in any known manner.

The throttle bodies 56, in turn, deliver the air charge to an intake manifold 59 that communicates with intake passages 61 formed in one side of the cylinder head member 49. Each of these intake passages 61 is split into two sections, each of which terminates at a respective one of a pair of intake valve seats 62 formed in the cylinder head surface 51. That is, the described construction for the engine 16 employs a four valve per cylinder arrangement that includes two intake valves 63 for each cylinder bore 41.

Although the invention is described in conjunction with a four valve overhead valve engine, it should be apparent to those skilled in the art that the invention can be practiced in conjunction with engines having any number of valves per cylinder and any specific valve orientation. However, the invention has particular utility with overhead valve engines for reasons which will become apparent.

The intake valves 63 are urged to their closed positions in a known manner. These valves 63 are also operated from an intake camshaft 64 also in any known manner. The intake camshaft 64 is journaled for rotation in the cylinder head member 49 in a cam cavity closed by a cam cover 65 and which cover completes the cylinder head assembly 42. The intake camshaft 64 is driven at one-half crankshaft speed by any suitable camshaft drive arrangement.

Fuel is also introduced to the cylinder head recesses 51 for combustion in the combustion chambers formed in part thereby. The manner of fuel charging forms no significant part of the invention, and, therefore, has not been illustrated. It will be readily apparent to those skilled in the art how the invention can be employed in conjunction with carburetors, manifold fuel injection, direct fuel injection, or any combination thereof or other variations of charge formers as normally employed with internal combustion engines.

Spark plugs (not shown) are mounted in the cylinder head member 49 and have their spark gap extending into the cylinder head recesses 51. The spark plugs are fired by a suitable ignition system which is not shown but which may include a flywheel magneto, indicated generally by the reference numeral 66 (FIG. 1), and which is driven off of the upper end of the crankshaft 21.

The charge which has been burnt in the combustion chambers is then discharged through an exhaust system which is indicated generally by the reference numeral 67. This exhaust system 67 includes a pair of exhaust valve seats 68 formed in each cylinder head recess 51 at the entry end of respective exhaust passages 69 formed in the cylinder head member 49. Again, although the invention is described in conjunction with an arrangement with two exhaust valve seats and two exhaust passages per cylinder, it should be readily apparent how the invention can be employed with other numbers of valves and passages.

Like the intake valve seats 62, the exhaust valve seats 68 are valved by poppet type exhaust valves 71 that are mounted in the cylinder head assembly 42. Suitable return springs are associated with the exhaust valves 71 as is an actuating exhaust camshaft 72. The exhaust camshaft 72 is also rotatably journaled in the cylinder head assembly 42 in any known manner and is driven at one-half crankshaft speed. The exhaust camshaft 72 is also enclosed within a cam chamber covered by the cam cover 65.

The exhaust passages 69 for each cylinder are Siamesed. Also, and as clearly seen in FIG. 2, these exhaust passages 69 have a re-entrant curvature so that they begin and end in openings that face forwardly within the power head 12. The exhaust passages 69 have outlet openings 73 which are formed in a surface of the cylinder head member 49 that is parallel to and in fact coextensive with the surface where the recesses 51 are formed. These exhaust outlet openings 73 are spaced vertically from each other and have a height in a vertical direction indicated at H1, as best seen in FIGS. 3 and 4.

These cylinder head exhaust outlet openings 73 communicate with an exhaust manifold, indicated generally by the reference numeral 74 and which is formed integrally in the cylinder block 39. This exhaust manifold 74 is comprised of a generally vertically extending collector section 75 which extends vertically downwardly and communicates with an exhaust opening formed in an exhaust guide 76 (FIG. 1) upon which the engine 16 is supported.

This exhaust guide 76, in turn, communicates with an exhaust pipe 70 that depends into an expansion chamber formed in the drive shaft housing 22. That expansion chamber, in turn, communicates with an exhaust system of a type normally used with outboard motors and is comprised of a type normally used with outboard motors that is comprised of a high speed underwater exhaust gas discharge and a low speed idle exhaust gas discharge. Since these systems are well known and the particular type of system which is employed performs no part of the invention, further description of it is not believed to be necessary to permit those skilled in the art to practice the invention.

Referring now again primarily to FIGS. 3 and 4, it will be seen that the collector section 75 is served by individual runner passages 77, each of which cooperate with a respective one of the cylinder head exhaust openings 73 to collect the exhaust gases and deliver them in a downward direction to the common section 75.

The way in which these openings 77 is formed is by employing a die so that the cylinder block can be die-cast. The die has tapered plugs that will extend into and form each opening 77. Thus, the openings 77 have inlet portions 78 which align with but have a greater vertical height than the cylinder head exhaust outlet opening 73. The lower ends of these openings 78 extend generally horizontally while the upper portions have a tapered section 79 that converges downwardly so as to define an outlet end that has a height H2 which is basically the same as the height H1 of the cylinder head exhaust outlet opening 73. However, they are staggered so as to provide in essence a curved flow path without having to form an actual curved opening in the cylinder head. Thus, this permits the die casting of the cylinder block 39 while still facilitating and forming a smooth exhaust opening.

This construction also permits the cylinder block water jacket, indicated by the reference numeral 81 to have an exhaust portion 81*e* that is juxtaposed to each of the surfaces 79. The exhaust gases exiting the cylinder head exhaust opening 73 will impinge upon these surfaces and thus be quickly cooled by the cooling jacket portions 81*e*. This also assists in silencing of the exhaust gases.

Thus, from the foregoing description it should be readily apparent that the described arrangement provides a very effective exhaust system for a four-cycle engine that has a vertically arranged cylinder block and which permits the use of a collector section and manifold formed in the cylinder block and which can be conveniently formed by die casting. Of course, the foregoing description is that of the preferred embodiment of the invention and various changes and modifications may be made without departing from the spirit and scope of the invention, as defined by the appended claims.

We claim:

1. An internal combustion engine having a cylinder block that defines at least one horizontally extending cylinder bore, a cylinder head affixed to said cylinder block and having a surface that closes said cylinder bore to form a combustion chamber with said cylinder bore and with a piston that reciprocates in said cylinder bore, at least one exhaust passage formed in said cylinder head, said cylinder head exhaust passage extending from said cylinder head surface that closes said cylinder bore and curving in a re-entrant fashion so as to form an exhaust gas opening in a surface of said cylinder head that extends parallel to said surface that closes said cylinder bore, the cylinder block has a portion that is in engagement with the cylinder head surface through which the exhaust passage opens, the cylinder block portion is formed with an exhaust manifold that includes a vertically downwardly extending passage and a runner section that extends from an opening that registers with the cylinder head exhaust gas opening and which terminates in the vertically extending portion, said cylinder block runner section having a first, upper surface that is inclined downwardly toward said vertically extending section from its opening in said cylinder block and which is in line with the upper edge of said cylinder head exhaust passage opening, the lower opening portion of said cylinder block runner passage extending downwardly below said cylinder head exhaust passage opening and extending also to said vertically extending passage in said cylinder block so that said runner section has a tapered configuration that defines an inlet opening that has a greater vertical height than said cylinder head exhaust outlet opening.

2. An internal combustion engine as set forth in claim 1 wherein the cylinder block has a cooling jacket juxtaposed to the cylinder block runner section first, upper surface.

3. An internal combustion engine as set forth in claim 1 wherein the opening area of the cylinder head exhaust passage opening is substantially equal to the discharge area of the runner section where it joins the vertically extending passage.

4. An internal combustion engine as set forth in claim 1 wherein the cylinder block has a plurality of vertically spaced cylinder bores and the cylinder head and cylinder block define at least one exhaust passage, exhaust passage opening and runner section as defined therein.

5. An internal combustion engine as set forth in claim 4 wherein the cylinder block has a cooling jacket juxtaposed to the cylinder block runner section first, upper surface.

6. An internal combustion engine as set forth in claim 5 wherein the opening area of the cylinder head exhaust passage opening is substantially equal to the discharge area of the runner section where it joins the vertically extending passage.

7. An internal combustion engine as set forth in claim 1 in combination with an outboard motor having a power head containing said engine and a surrounding protective cowling for said engine, a driveshaft housing and lower unit depending from said power head and containing a propulsion device driven by said engine, and an exhaust system in said driveshaft housing and lower unit for receiving exhaust gasses from the vertically extending passage.

8. The outboard motor as set forth in claim 7 wherein the engine is mounted on an exhaust guide at the upper end of the driveshaft housing and lower unit and the exhaust system includes an exhaust pipe depending from said exhaust guide.

9. An outboard motor as set forth in claim 8 wherein the cylinder block has a cooling jacket juxtaposed to the cylinder block runner section first, upper surface.

10. An outboard motor as set forth in claim 8 wherein the opening area of the cylinder head exhaust passage opening is substantially equal to the discharge area of the runner section where it joins the vertically extending passage.

11. An outboard motor as set forth in claim 8 wherein the cylinder block has a plurality of vertically spaced cylinder bores and the cylinder head and cylinder block define at least one exhaust passage, exhaust passage opening and runner section as defined therein.

12. An outboard motor as set forth in claim 11 wherein the cylinder block has a cooling jacket juxtaposed to the cylinder block runner section first, upper surface.

13. An outboard motor as set forth in claim 12 wherein the opening area of the cylinder head exhaust passage opening is substantially equal to the discharge area of the runner section where it joins the vertically extending passage.

* * * * *